US010388443B2

(12) United States Patent
Miwa et al.

(10) Patent No.: US 10,388,443 B2
(45) Date of Patent: Aug. 20, 2019

(54) R-T-B BASED SINTERED MAGNET

(71) Applicant: TDK CORPORATION, Tokyo (JP)

(72) Inventors: Masashi Miwa, Tokyo (JP); Takurou Iwasa, Tokyo (JP); Haruna Nakajima, Tokyo (JP)

(73) Assignee: TDK CORPORATION, Tokyo (JP)

( * ) Notice: Subject to any disclaimer, the term of this patent is extended or adjusted under 35 U.S.C. 154(b) by 718 days.

(21) Appl. No.: 15/015,462

(22) Filed: Feb. 4, 2016

(65) Prior Publication Data

US 2016/0225501 A1 Aug. 4, 2016

(30) Foreign Application Priority Data

Feb. 4, 2015 (JP) ..... 2015-020059

(51) Int. Cl.

| | |
|---|---|
| ***H01F 1/153*** | (2006.01) |
| ***H01F 1/053*** | (2006.01) |
| ***H01F 1/08*** | (2006.01) |
| ***H01F 1/057*** | (2006.01) |

(52) U.S. Cl.

CPC ..... *H01F 1/086* (2013.01); *H01F 1/0577* (2013.01)

(58) Field of Classification Search

None

See application file for complete search history.

(56) References Cited

U.S. PATENT DOCUMENTS

| | | | | |
|---|---|---|---|---|
| 6,120,620 | A * | 9/2000 | Benz | H01F 1/0577 148/101 |
| 2004/0094237 | A1* | 5/2004 | Nomura | H01F 1/0577 148/302 |
| 2015/0170810 | A1* | 6/2015 | Miwa | C22C 38/001 75/246 |

FOREIGN PATENT DOCUMENTS

| | | | | |
|---|---|---|---|---|
| JP | H01-219143 | A | 9/1989 | |
| JP | 2000-234151 | A | 8/2000 | |
| JP | 2002-075717 | A | 3/2002 | |
| WO | WO-2013191276 | A1 * | 12/2013 | C22C 38/001 |

* cited by examiner

*Primary Examiner* — Xiaowei Su
(74) *Attorney, Agent, or Firm* — Oliff PLC

(57) ABSTRACT

The present invention provides an R-T-B based sintered magnet having an R-T-B based compound as main phase grains, wherein, the content of Zr contained in the R-T-B based sintered magnet is 0.3 mass % to 2.0 mass %, the main phase grains have Zr, and the R-T-B based sintered magnet have main phase grains with the mass concentration of Zr at the edge portion of the main phase grain being 70% or less of that at the central portion of the main phase grain at the cross-section of the main phase grain.

8 Claims, 5 Drawing Sheets

R-T-B BASED SINTERED MAGNET

The present invention relates to an R-T-B based sintered magnet having a rare earth element (R), at least one iron family element (T) with Fe or the combination of Fe and Co as the necessity, and boron (B) as its main components.

BACKGROUND

The R-T-B based sintered magnet shows excellent magnetic properties and thus is used in the voice coil motor (VCM) in a hard disk drive, various motors such as the motor equipped in a hybrid electric vehicle, household electrical appliances or the like.

Researches and developments have been actively conducted to improve the magnetic properties of the R-T-B based sintered magnet. For example, in Patent Document 1, it has been reported that the magnetic properties can be enhanced and the conditions for thermal treatment also can be improved by adding 0.02 to 0.5 at % of Cu into the R-T-B based rare earth based permanent magnet. However, the method described in Patent Document 1 cannot achieve sufficiently high magnetic properties required in a magnet with good performance such as a high coercivity (HcJ) and a high residual magnetic flux density (Br).

In order to turn the R-T-B based sintered magnet into a magnet with further improved performance, the oxygen content in the alloy needs to decrease. However, if the oxygen content in the alloy is decreased, abnormal grain growth is likely to happen during the sintering process, resulting in a decreased squareness ratio or a substantial decline in coercivity. Since the oxides formed by the oxygen in the alloy prevent grains from growing, the decline of oxygen content in the alloy is likely to cause the abnormal grain growth.

Accordingly, a method is studied to enhance the magnetic properties by adding new elements in the R-T-B based sintered magnet containing Cu. In Patent Document 2, it is reported that Zr and/or Cr are/is added to provide a high coercivity and a high residual magnetic flux density.

Similarly, Patent Document 3 has reported to uniformly disperse and precipitate a finely divided ZrB compound, NbB compound or HfB compound in an R-T-B based rare earth permanent magnet containing Co, Al and Cu and further containing Zr, Nb or Hf. In this way, the grain is prevented from growing during the sintering process so as to improve the magnetic properties and the sintering temperature range.

Recently, in order to decrease the amount of the heavy rare earth elements with rare resource in use such as Dy or Tb, a method is adopted in which the main phase grains in the R-T-B based sintered magnet are micronized to improve the coercivity. However, if the main phase grains in the sintered magnet are to be micronized, the finely pulverized powder of raw materials has to be reduced in particle size. If the particle size of the finely pulverized powder is reduced, the abnormal grain growth tends to occur during the sintering process. Thus, when the finely pulverized powder with a small particle size is used as the raw material, the sintering temperature needs to be a low temperature so that a sintering process is performed for a relative long time, resulting in a substantial decline in productivity. As a method in which the finely pulverized powder with such a small particle size is used and the sintering process is conducted under the same conditions as those in the conventional method, it is considered that the amount of Zr to be added as the element having a high effect in preventing from abnormal grain growth has to be further increased. However, with the increase of the addition amount of Zr, technical problems will arise that the residual magnetic flux density decreases and good properties aimed to provide cannot be obtained.

PATENT DOCUMENTS

Patent document 1: JP-A-H1-219143
Patent document 2: JP-A-2000-234151
Patent document 3: JP-A-2002-75717

SUMMARY

The present invention has been made by considering the above conditions, and the object of the present invention is to provide an R-T-B based sintered magnet which has good magnetic properties by minimizing the deterioration of magnetic properties and inhibiting grain growth.

In order to achieve the object, the present inventors have studied the required conditions for inhibiting the grain growth by the addition of Zr. As a result, it has been discovered that the presence of Zr in the main phase grains will also produce an inhibitory effect on grain growth although it is conventionally considered that the grain growth can be inhibited by depositing Zr based compound such as ZrB at the grain boundary of the sintered magnet. It has been further discovered that a high residual magnetic flux density and a high coercivity can be achieved if a structure is provided with the mass concentration of Zr at the edge portion of the main phase grain being lower than that at the central portion of the main phase grain.

The mechanism has not been completely determined and is considered as follows. That is, when the Zr based compound is deposited at the grain boundary in a conventional manner, only the ratio of the nonmagnetic phase in the grain boundary increases, leading to a decreased residual magnetic flux density. On the contrary, if Zr is present in the main phase grains in a manner proposed in the present invention, the nonmagnetic phase in the grain boundary can be prevented from increasing and the decrease of the residual magnetic flux density can be inhibited. On the other hand, if Zr is present in the main phase grains, Zr forms a solid solution in the R-T-B based compound and the anisotropic magnetic field decreases in intensity. In this respect, the coercivity tends to decrease. However, it is considered that when a structure is formed with the Zr concentration at the edge portion of the main phase grain being lower than that at the central portion as described in the present invention, a high coercivity together with the inhibitory effect on abnormal grain growth will be provided by inhibiting the intensity decrease of the anisotropic magnetic field in the vicinity of the surface of the main phase grain and also inhibiting the nucleation of magnetization reversal on the surface of the main phase grain.

The present invention has come out based on the discovery mentioned above. The R-T-B based sintered magnet of the present invention is characterized in that it contains an R-T-B based compound as the main phase grains, wherein the content of Zr contained in the R-T-B based sintered magnet is 0.3 mass % to 2.0 mass %, the main phase grains contain Zr, and the R-T-B based sintered magnet contains main phase grains with the mass concentration of Zr at the edge portion in the main phase grains being 70% or less of that at the central portion in the main phase grains at the cross-sections of the main phase grains.

The grain growth during the sintering process can be inhibited in the R-T-B based sintered magnet of the present invention. Meanwhile, the R-T-B based sintered magnet has a high residual magnetic flux density and a high coercivity.

The R-T-B based sintered magnet of the present invention preferably contains main phase grains with the mass concentration of Zr at the edge portion in the main phase grains being 40% or less of that at the central portion in the main phase grains. With such a distribution of mass concentration of Zr in the main phase grains, the coercivity of the R-T-B based sintered magnet can be further enhanced.

Preferably, in the R-T-B based sintered magnet of the present invention, the mass concentration of Zr at the edge portion in the main phase grains is 0.15 mass % or less. When the mass concentration of Zr at the edge portion in the main phase grains is at such a low level, the coercivity of the R-T-B based sintered magnet can be further increased.

According to the present invention, an R-T-B based sintered magnet with good magnetic properties can be provided by minimizing the decrease of magnetic properties and also inhibiting the grain growth.

DETAILED DESCRIPTION OF EMBODIMENTS

Figure 1:
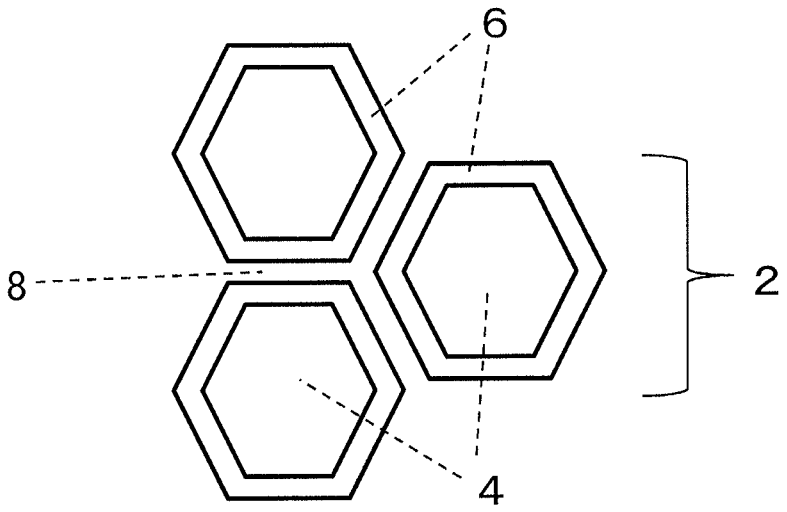
FIG. 1 is a schematic sectional view of the R-T-B based sintered magnet according to the present invention.

Hereinafter, the present invention will be described based on the embodiments shown in the drawings.

<R-T-B Based Sintered Magnet>

The embodiments of the R-T-B based sintered magnet of the present invention will be described. As shown in FIG. 1, the R-T-B based sintered magnet in the present embodiment contains several main phase grains 2 as well as grain boundary phases 8 present in the grain boundary of the main phase grains.

The main phase grain 2 is composed of an R-T-B based compound. As the R-T-B based compound, $R_2T_{14}B$ with a crystal structure formed by tetragonal $R_2T_{14}B$ can be listed as an example.

R represents at least one rare earth element. The rare earth element refers to Sc, Y and lanthanoid elements, which belong to the third group in the long period type periodic table. The lanthanoid elements include, for example, La, Ce, Pr, Nd, Sm, Eu, Gd, Tb, Dy, Ho, Er, Tm, Yb, Lu and the like. The rare earth element is classified as the light rare earth and the heavy rare earth. The heavy rare earth element refers to Gd, Tb, Dy, Ho, Er, Tm, Yb and Lu while the light rare earth element refers to the other rare earth elements.

In the present embodiment, T represents one or more iron family elements including Fe or the combination of Fe and Co. T may be Fe alone or Fe partly substituted by Co. When part of Fe is substituted by Co, the temperature properties can be improved without deteriorating magnetic properties.

In the R-T-B based compound of the present embodiment, part of B can be substituted with carbon (C). In this case, the preparation of the magnet becomes easy and the production cost can be decreased. Further, the amount of C to substitute B is substantially an amount having no effect on the magnetic properties.

The R-T-B based compound of the present embodiment may also contain various well-known additive elements. In particular, at least one element selected from the group consisting of Ti, V, Cu, Cr, Mn, Ni, Zr, Nb, Mo, Hf, Ta, W, Al, Ga, Si, Bi and Sn may be contained.

In the present embodiment, the main phase grains 2 contain Zr. When the main phase grains 2 contain Zr, the grain growth can be inhibited during sintering even if a pulverized raw material powder with a small particle size is used. The presence of Zr in the main phase grains can be confirmed by analyzing Zr in the region of the main phase grains in the cross-section of the sintered magnet by an analysis method such as one using EPMA (Electron Probe Micro Analyzer).

In the present embodiment, main phase grains with the mass concentration of Zr at the edge portion 6 in the main phase grains being lower than that at the central portion 4 in the main phase grains are contained as the main phase grain.

Figure 2:
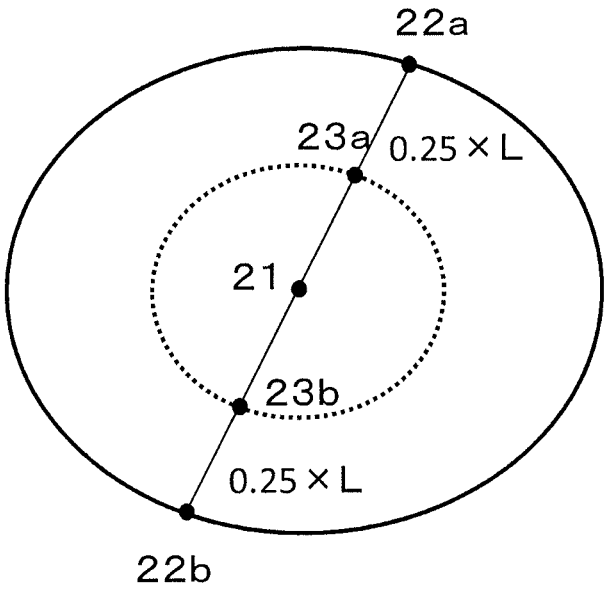
FIG. 2 is a schematic sectional view of the main phase grains of the R-T-B based sintered magnet according to the present invention.

FIG. 2 is a schematic view showing the method for measuring the mass concentration of Zr at both the edge portion and the central portion of the main phase grain in the present embodiment. First of all, the gravity center 21 of a main phase grain is determined through an image analysis on the cross-section of the main phase grain to be measured. The position where the gravity center 21 of the main phase grain is located can be determined by projecting the image of the cross-section of the main phase grain on the X-Y plane and then averaging the X values and Y values of all pixels inside the main phase grain. Then, in the cross-section of the main phase grain, a random straight line is introduced to go across the main phase grain and also cross through the gravity center 21 of the main phase grain, and the points where this straight line and the outermost periphery intersect are defined as Point 22*a* and Point 22*b*. When the length of the line segment 22*a*-22*b* is set as L, a point having a distance of 0.25×L away from Point 22*a* on the line segment 22*a*-22*b* is set as Point 23*a* and a point having a distance of 0.25×L away from Point 22*b* is set as Point 23*b*. Next, with an analysis method such as EPMA, the mass concentration of Zr is analyzed quantitatively along the line segment 22*a*-22*b* with a certain interval between two analysis points. The average of the Zr mass concentrations at analysis points on the line segment 23*a*-23*b* is defined as Mc, and the average of the Zr mass concentrations of the analysis points on the line segment 22*a*-23*a* and the line segment 22*b*-23*b* is defined as Ms. Thus, Mc is specified as the mass concentration of Zr at the central portion of the main phase grain and Ms is specified as the mass concentration of Zr at the edge portion of the main phase grain. In addition, in the analysis, the interval between two adjacent analysis points used in the quantitative analysis of Zr mass concentration along the line segment 22*a*-22*b* is set in such a manner that the central portion and the edge portion of the main phase grain respectively have four or more analysis points.

In the present embodiment, when Ms (i.e., the mass concentration of Zr at the edge portion of the main phase grain) measured by the steps mentioned above is 70% or less of Mc (i.e., the mass concentration of Zr at the central portion of the main phase grain), the mass concentration of Zr at the edge portion of the main phase grain is determined to be lower than that at the central portion of the main phase grain.

As described above, as main phase grains with the mass concentration of Zr at the edge portion of the main phase grains being 70% or lower of that at the central portion of the main phase grain are contained as the main phase grain, the decrease of the residual magnetic flux density and the decrease of coercivity accompanying the increased content of Zr can be inhibited. In addition, the grain growth during sintering can be prevented even if a pulverized raw material powder with a small particle size is used.

The ratio (Ms/Mc) of Ms (i.e., the mass concentration of Zr at the edge portion of the main phase grain) to Mc (i.e., the mass concentration of Zr at the central portion of the main phase grain) is preferably 40% or less. With such a range, a high coercivity can be easily provided.

The mass concentration of Zr at the edge portion of the main phase grain (Ms) is preferably 0.15 mass % or less. With the mass concentration of Zr at the edge portion of the main phase grain being at such a low level, the nucleation of magnetization reversal on the surface of the main phase grains can be prevent so that the coercivity can be further improved.

The R-T-B based sintered magnet in the present embodiment may be, for example, prepared as described later. In particular, an alloy in which Zr is solid-soluted into the R-T-B based main phase compound is produced by controlling the casting conditions during casting the raw material alloy, and the preparation conditions in the preparation process such as the sintering pattern are further controlled.

In the present embodiment, not all the main phase grains constituting the R-T-B based sintered magnet need to have a structure with the distribution of Zr mass concentration as mentioned above. In other words, the main phase grains with such a structure should account for 30% or more of the total main phase grains. When less than 30% of main phase grains are contained with such a structure, it is hard to fully exert the effect of the present invention.

In the present embodiment, the sectional area of each main phase grain at the section parallel to the c-axis inside the R-T-B based sintered magnet is calculated by a method such as image processing, and the diameter of a circle having said sectional area (i.e., the equivalent circle diameter) is defined as the grain size of the main phase grain at this section. Further, the grain size of the main phase grain (whose cross-sectional area is cumulative 50% of the entire cross-sectional area accumulated from the main phase grain with a small cross-sectional area) is defined as the average grain size of the main phase grains.

The average grain size of the main phase grains is preferably 4.0 μm or less. If the average grain size of the main phase grains is larger than 4.0 μm, the coercivity tends to decrease. In addition, the average grain size of the main phase grains is preferably 1.5 μm or larger. If the average grain size is smaller than 1.5 μm, it is likely that main phase grains having the distribution of Zr mass concentration mentioned above can not successfully be formed. Further, from the viewpoint of improvement of magnetic properties, the average grain size of the main phase grains is more preferably 1.5 μm or more and 3.5 μm or less.

In the present embodiment, Zr can be further present in the grain boundary phase 8 in addition to the main phase grain 2. Zr can be present in the grain boundary phase 8 in the form of, for example, a Zr based compound such as ZrB, ZrC and the like.

The content of R in the R-T-B based sintered magnet of the present embodiment is 25 mass % or more and 35 mass % or less, and preferably 29 mass % or more and 34 mass % or less. When the content of R is less than 25 mass %, the generation of R-T-B based compound which is the main phase of the R-T-B based sintered magnet is insufficient. Thus, soft magnetic materials such as α-Fe may be deposited and the magnetic properties may deteriorate. In addition, in the present embodiment, from the viewpoint of cost reduction and avoidance of resource risks, the content of the heavy rare earth element contained as R is preferably 1.0 mass % or less.

The content of B in the R-T-B based sintered magnet of the present embodiment is 0.5 mass % or more and 1.5 mass % or less. If the content of B is less than 0.5 mass %, the coercivity Ha tends to decrease. If the content is higher than 1.5 mass %, the residual magnetic flux density Br tends to decrease.

Further, in the present embodiment, the content of B in the R-T-B based sintered magnet is preferably 0.7 mass % or more and 0.95 mass % or less, and more preferably 0.75 mass % or more and 0.90 mass % or less. With the content of B decreased as compared to that in the conventional R-T-B based sintered magnet, an effect will be produced that Zr may hardly go into the grain boundary and may easily exist in the main phase grains. The reason for that is not clear at the current stage. It may be guessed that the defects of B are generated in the R-T-B based compound that is the main phase so that Zr will be easily solid-soluted into the R-T-B based compound.

As described above, T represents at least one iron family element including Fe or the combination of Fe and Co. The content of Fe in the R-T-B based sintered magnet of the present embodiment is substantially the balance of the constituent elements for the R-T-B based sintered magnet, and part of Fe can be substituted with Co. The content of Co is preferably 0.3 mass % or more and 4.0 mass % or less, and more preferably 0.5 mass % or more and 3.0 mass % or less. If the content of Co exceeds 4 mass %, the residual magnetic flux density tends to decrease. In addition, the R-T-B based sintered magnet in the present embodiment tends to be more expensive. On the other hand, if the content of Co is less than 0.3 mass %, the corrosion resistance tends to deteriorate.

The R-T-B based sintered magnet of the present embodiment needs to contain Zr. In the present embodiment, the content of Zr is 0.3 mass % or more and 2.0 mass % or less. If the content is less than 0.3 mass %, the inhibitory effect on the grain growth cannot be sufficiently obtained. If the content is more than 2.0 mass %, the residual magnetic flux density Br tends to decrease.

The R-T-B based sintered magnet in the present embodiment preferably contains Ga. The content of Ga is preferably 0.05 to 1.5 mass %, and more preferably 0.3 to 1.0 mass %. With Ga, an effect will be produced that Zr may hardly go into the grain boundary and will readily exist in the main phase grains. The reason is assumed to be the same with that in the case where B content is decreased. In particular, Ga is solid-soluted into the R-T-B based compound of the main phase, resulting in changes in the crystal lattices, and thus Zr will be readily solid-soluted into the R-T-B based compound. If the content of Ga is less than 0.05 mass %, it is hard for Zr to enter the main phase grains. Thus, it is likely that the effect of the present invention will hardly be produced. In addition, if the content of Ga is over 1.5 mass %, the residual magnetic flux density tends to decrease.

The R-T-B based sintered magnet in the present embodiment preferably contains Cu. The content of Cu is preferably 0.05 to 1.5 mass %, and more preferably 0.3 to 1.0 mass %. With Cu contained, the obtained magnet will have a high coercivity and a high corrosion resistance and also have its temperature properties improved. If the content of Cu is higher than 1.5 mass %, the residual magnetic flux density tends to decrease. Besides, if the content of Cu is lower than 0.05 mass %, the coercivity tends to decrease.

The R-T-B based sintered magnet in the present embodiment preferably contains Al. With Al contained, the obtained magnet will have a high coercivity and a high corrosion resistance and also have its temperature properties improved. The content of Al is preferably 0.03 mass % or more and 0.6 mass % or less, and more preferably 0.05 mass % or more and 0.4 mass % or less.

Additive elements other than those mentioned above can be contained in the R-T-B based sintered magnet of the present embodiment. In particular, Ti, V, Cr, Mn, Ni, Nb, Mo, Hf, Ta, W, Si, Bi, Sn, Ca and the like can be listed as examples.

A certain amount of oxygen (O) can be contained in the R-T-B based sintered magnet of the present embodiment. Said certain amount varies depending on other parameters and can be suitably determined. The content of oxygen is preferably 500 ppm or more from the viewpoint of corrosion resistance. Further, if the magnetic properties are considered, the content is preferably 2000 ppm or less.

The content of carbon (C) in the R-T-B based sintered magnet according to the present embodiment is preferably 500 ppm or more and 3000 ppm or less, and more preferably 1200 ppm or more and 2500 ppm or less. If the content of carbon is over 3000 ppm, the magnetic properties of the obtained R-T-B based sintered magnet tend to deteriorate. On the other hand, if the content is less than 500 ppm, the orientation will become difficult during the pressing process under a magnetic field. Since carbon is mainly added by the means of the lubricant during pressing, its content can be adjusted by controlling the amount of the lubricant.

In addition, a certain amount of nitrogen (N) can be contained in the R-T-B based sintered magnet according to the present embodiment. Said certain amount varies depending on other parameters and can be suitably determined. The content of nitrogen is preferably 100 to 2000 ppm from the viewpoint of magnetic properties.

The R-T-B based sintered magnet of the present embodiment is usually used after being machined into any shape. The shape of the R-T-B based sintered magnet according to the present embodiment is not particularly limited, and it may be a columnar shape such as a cuboid, a hexahedron, a tabular shape, a quadrangular prism and the like. A cross-sectional shape of the R-T-B based sintered magnet may be an arbitrary shape such as C-shaped cylindrical shape. As for a quadrangular prism, the quadrangular prism can be one with its bottom surface being a rectangle or one with the bottom surface being a square.

In addition, the R-T-B based sintered magnet according to the present embodiment includes both a magnet product in which the present magnet has been magnetized after machining and a magnet product in which the present magnet has not been magnetized.

<Manufacturing Method of R-T-B Based Sintered Magnet>

Figure 3:
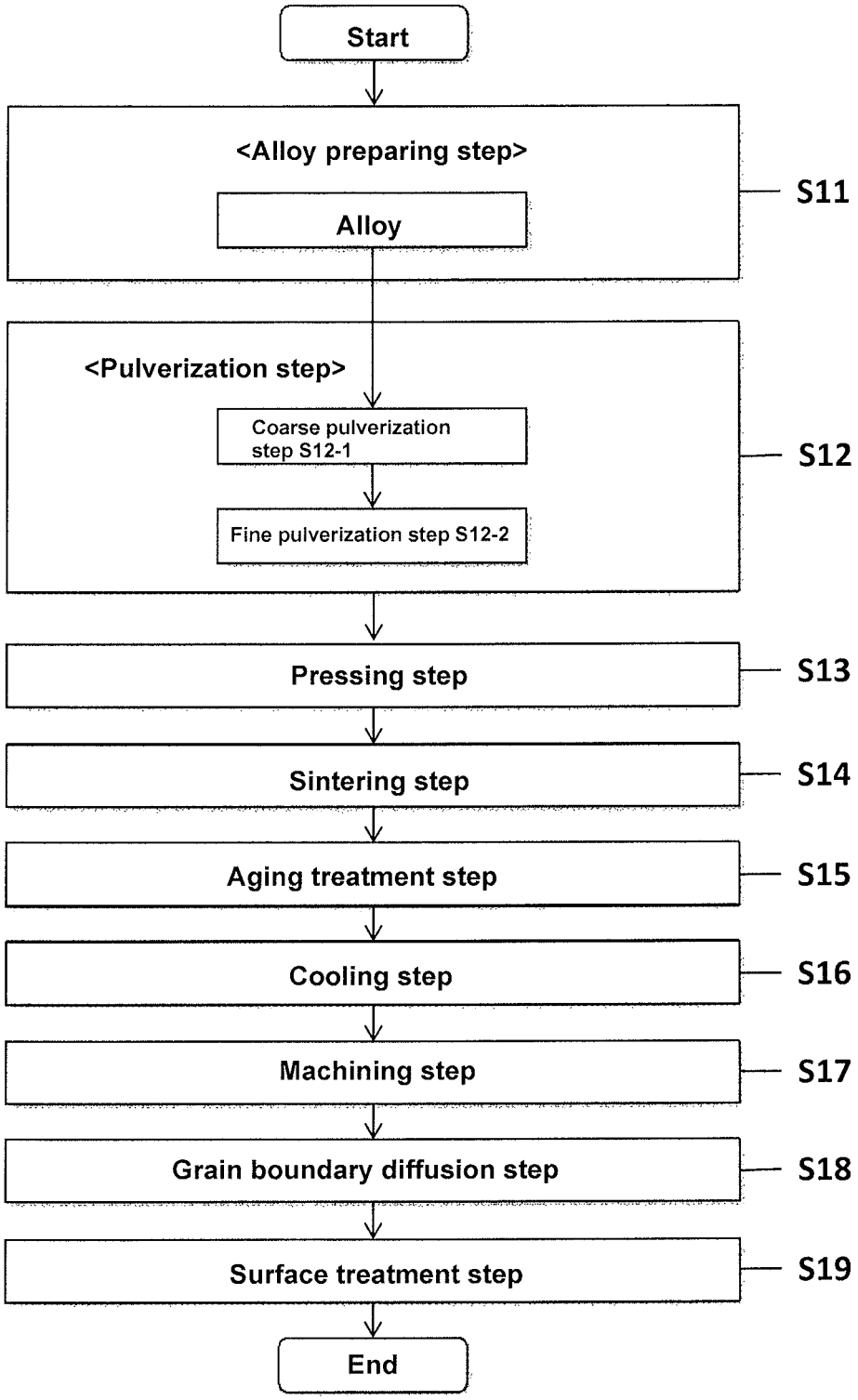
FIG. 3 is a flow chart showing an example of the method for preparing the R-T-B based sintered magnet of the present invention.

An example of the method for manufacturing the R-T-B based sintered magnet of the present embodiment with the structure mentioned above will be described with reference to the drawings. FIG. 3 is a flow chart showing an example of the manufacturing method of the R-T-B based sintered magnet according to the present embodiment. As shown in FIG. 3, a method for manufacturing the R-T-B based sintered magnet according to the present embodiment contains the following steps.

(a) An alloy preparing step where an alloy is prepared (Step S11);
(b) A pulverization step where the alloy is pulverized (Step S12);
(c) A pressing step where the alloy powder is pressed (Step S13);
(d) A sintering step where the green compact is sintered to provide an R-T-B based sintered magnet (Step S14);
(e) An aging treatment step where the R-T-B based sintered magnet is subjected to an aging treatment (Step S15);
(f) A cooling step where the R-T-B based sintered magnet is cooled (Step S16);
(g) A machining step where the R-T-B based sintered magnet is machined (Step S17);
(i) A grain boundary diffusion step where a heavy rare earth element is diffused in the grain boundary of the R-T-B based sintered magnet (Step S18);
(j) A surface treatment step where the R-T-B based sintered magnet is subjected to a surface treatment (Step S19).

[Alloy Preparing Step: Step S11]

In the manufacture of the R-T-B based sintered magnet of the present embodiment, a raw material alloy constituting the R-T-B based sintered magnet is prepared firstly (an alloy preparing step (Step S11)). In this alloy preparing step (Step S11), the raw material metals corresponding to the composition of the R-T-B based sintered magnet of the present embodiment are melted under vacuum or in an inert gas atmosphere such as Ar gas. Then, they were casted to provide the alloy having a desired composition. In addition, in the present embodiment, a single-alloy method using one kind of alloy is described. However, a two-alloy method where the raw material powder is manufactured by casting two kinds of alloys and then mixing them can also been employed.

As the raw material metal, for instance, a rare earth metal or a rare earth alloy, a pure iron, ferro-boron, and further the alloy or compound thereof can be used. The casting method for casting the raw material metals can be, for example, an ingot casting method, a strip casting method, a book molding method, a centrifugal casting method or the like. In particular, the strip casting method is preferable.

In the present embodiment, as Zr needs to exist in the main phase grains of the R-T-B based sintered magnet, Zr has to be solid-soluted into the R-T-B based compound of the main phase in the alloy stage. In order to manufacture such an alloy, when the strip casting method is used, the molten metal temperature at which the raw material metals are melted and also the cooling rate have to be controlled. The optimal conditions will vary depending on the composition of the alloy. Specifically, the molten metal temperature is preferably set at a range of 1450° C. to 1550° C. that is higher than the conventional one, and the cooling rate is controlled to be 1500° C./sec or higher.

[Pulverization Step: Step S12]

Then, the alloy obtained after casting is pulverized (a pulverization step (Step S12)). This pulverization step (Step S12) includes a coarse pulverization step (Step S12-1) where the alloy is pulverized to have a particle size of several hundreds of μm to several mm and a fine pulverization step (Step S12-2) where the fine pulverization is performed to have a particle size of several μm.

(Coarse Pulverization Step: Step S12-1)

The alloy obtained after casting is coarsely pulverized to provide a particle size of several hundreds of μm to several mm (the coarse pulverization step (Step S12-1)). In this way, the coarsely pulverized powder of the alloy is thus obtained. The coarse pulverization can be performed as follows. First of all, the hydrogen is stored to the alloy. Then, the hydrogen is emitted based on the difference of hydrogen storage amount among different phases. And with the dehydrogenation, a self-collapsed-type pulverization (a hydrogen storage pulverization) occurs.

Further, in addition to the hydrogen storage pulverization mentioned above, the coarse pulverization step (Step S12-1) can also be performed by using a coarse pulverizer such as a stamp mill, a jaw crusher, a brown mill and the like in an inert gas atmosphere.

Further, in order to provide good magnetic properties, the atmosphere of each step, from the pulverization step (Step S12) to the sintering step (Step S15), is preferable with a low concentration of oxygen. The concentration of oxygen can be adjusted by controlling the atmosphere in each manufacturing step. In case the concentration of oxygen is high in each manufacturing step, the rare earth element in the alloy powder is oxidized to generate the oxide of R. The oxide of R will be deposited directly in the grain boundary without being reduced in the sintering process, resulting in a decreased Br in the obtained R-T-B based sintered magnet. Thus, the oxygen concentration in each step is preferably, for example, 100 ppm or less.

(Fine Pulverization Step: Step S12-2)

After the alloy is coarsely pulverized, the obtained coarsely pulverized powder is finely pulverized to provide an average particle size of approximately several μm (a fine pulverization step (Step S12-2)). In this way, the finely pulverized powder of the alloy is then obtained. As the coarsely pulverized powder is further finely pulverized, a finely pulverized powder can be obtained with a particle size of 0.1 μm or more and 5 μm or less and more preferably 1 μm or more and 3 μm or less.

The fine pulverization is conducted by suitably adjusting conditions such as the pulverization time and the like and at the same time performing further pulverization to the coarsely pulverized powder using a fine pulverizer such as a jet mill, a bead mill and the like. The jet mill is used to perform the pulverization method as follows. The jet mill discharges inert gas (e.g., $N_2$ gas) at a high pressure from a narrow nozzle to produce a high-speeded gas flow. The coarsely pulverized powder is accelerated by this high-speeded gas flow, causing a collision between the coarsely pulverized powder particles or a collision between the coarsely pulverized powder and a target or the wall of a container.

When the jet mill is used to provide a finely pulverized powder with a small particle size, the pulverized powder has a very high surface activity. In this way, the pulverized powder is likely to performed re-agglomeration with each other or attach to the wall of a container, and thus the yield tends to decrease. Therefore, by adding a pulverization aid such as zinc stearate, oleic amide and the like during the fine pulverization of the coarsely pulverized powder, the powder can be prevented from re-agglomerating or attaching to the wall of a container. In this way, the finely pulverized powder can be obtained in a high yield. In addition, with the pulverization aid being added in this way, a finely pulverized powder that can be oriented easily during the pressing step can be obtained. The amount of the pulverization aid to be added varies depending on the particle size of the finely pulverized powder or the type of the pulverization aid to be added, and it is preferably approximately 0.1 mass % to 1 mass %.

[Pressing Step: Step S13]

After the fine pulverization, the finely pulverized powder is pressed to have a target shape (a pressing step (Step S13)). In the pressing step, the finely pulverized powder of the alloy is filled in a press mold surrounded by an electromagnet, and then a pressure is applied thereto. In this way, the finely pulverized powder is pressed to provide an arbitrary shape. A magnetic field is applied during that time, and a predetermined orientation is produced in the raw material powder by the applied magnetic field. Then, the raw material powder is pressed with the crystal axis oriented under the magnetic field. Thus, a green compact is obtained. As the resultant green compact is oriented in a specified direction, an anisotropic R-T-B based sintered magnet with stronger magnetism can be provided.

The pressure provided during the pressing step is preferably 30 MPa to 300 MPa. The intensity of the applied magnetic field is preferably 950 kA/m to 1600 kA/m. The applied magnetic field is not limited to a magnetostatic field, and it can also be a pulsed magnetic field. In addition, a magnetostatic field and a pulsed magnetic field can be used in combination.

Further, in addition to the dry pressing method as described above where the finely pulverized powder is pressed directly, the pressing method can also be a wet pressing where a slurry obtained by dispersing the raw material powder in a solvent such as an oil is pressed.

The shape of the green compact obtained by pressing the finely pulverized powder is not particularly limited and can be an arbitrary shape such as a cuboid, a tabular shape, a columnar shape, a ring shape and the like in accordance with the desired shape of the R-T-B based sintered magnet.

[Sintering Step: Step S14]

The green compact pressed in a magnetic field to have a target shape is sintered under vacuum or in an inert atmosphere so that an R-T-B based sintered magnet is obtained (a sintering step (Step S14)). The green compact is sintered by performing a thermal treatment under vacuum or in an inert atmosphere at 900° C. or more and 1200° C. or less for an hour or more and 30 hours or less. Thereby, a liquid-phase sintering occurs in the finely pulverized powder, and then an R-T-B based sintered magnet (a sintered body of R-T-B based magnet) is obtained with an increased volume ratio occupied by the main phase.

In the present embodiment, the edge portion with a low mass concentration of Zr will be readily formed in the main phase grains by controlling the cooling rate after the sintered body is kept at the sintering temperature for a certain time during the sintering step. In particular, it is preferable that the sintered body is slowly cooled from the sintering temperature to 800° C. and then rapidly cooled. The cooling rate from the sintering temperature to 800° C. is preferably set to be 2° C./minute to 6° C./minute.

The reason is not so clear why the edge portion with a low mass concentration of Zr will be readily formed in the main phase grains by controlling the cooling rate in such a manner as described above. The mechanism is assumed as follows.

(1) With the control of the constituent elements and casting conditions, Zr is solid-soluted in the R-T-B based compound of the main phase before sintering.
(2) At the sintering temperature, the grain boundary phase turns to a liquid phase and part of the main phase grains dissolve to form a liquid phase so that the sintering process proceeds.
(3) When the sintered body is cooled from the sintering temperature, the R-T-B based compound is re-deposited from the liquid phase on the surface of the main phase grains. If the cooling rate is rather fast, Zr is likely to enter the R-T-B based compound. On the contrary, if the cooling rate is declined, it is difficult for Zr to enter the R-T-B based compound. The Zr that has not entered the R-T-B based compound deposits in the grain boundary phase as the Zr based compound.

(4) With the process mentioned above, Zr which has been solid-soluted at the initial alloy stage will directly remain at the central portion of the main phase grains. On the other hand, Zr in the edge portion is formed by re-depositing from the liquid phase, and its concentration becomes lower. As such, the structure is formed with a concentration distribution of Zr in the main phase grains.

[Aging Treatment Step: Step S15]

After the green compact is sintered, the R-T-B based sintered magnet is subjected to an aging treatment (an aging treatment step (Step S15)). After the sintering step, an aging treatment is provided to the R-T-B based sintered magnet by keeping the R-T-B based sintered magnet at a temperature lower than that during sintering. The aging treatment can be, for example, either done in two stages or in one single stage. In the two-stage heating treatment, the R-T-B based sintered magnet is heated at 700° C. or more and 900° C. or less for 1 hour to 3 hours and then further heated at 500° C. to 700° C. for 1 hour to 3 hours. In the single-stage heating treatment, the R-T-B based sintered magnet is heated at around 600° C. for 1 hour to 3 hours. The treatment conditions can be suitably adjusted based on the number of times the aging treatment to be done. With such an aging treatment, the magnetic properties of the R-T-B based sintered magnet can be improved. In addition, the aging treatment step (Step S15) can be performed after a machining step (Step S17) or a grain boundary diffusion step (Step S18).

[Cooling Step: Step S16]

After an aging treatment is provided to the R-T-B based sintered magnet, the R-T-B based sintered magnet is rapidly cooled in an Ar atmosphere (a cooling step (Step S16)). In this way, the R-T-B based sintered magnet according to the present embodiment is obtained. The cooling rate is not particularly limited, and it is preferably 30° C./min or higher.

[Machining Step: Step S17]

The obtained R-T-B based sintered magnet may be machined to have a desired shape if required (a machining step: Step S17). The machining method can be, for example, a shaping process such as cutting, grinding and the like, and a chamfering process such as barrel polishing and the like.

[Grain Boundary Diffusion Step: Step S18]

A step where the heavy rare earth element is further diffused in a grain boundary of the machined R-T-B based sintered magnet may be included (a grain boundary diffusion step: Step S18). The grain boundary diffusion can be performed by adhering a compound containing the heavy rare earth element on the surface of R-T-B based sintered magnet through coating, depositing or the like followed by a thermal treatment, or alternatively by providing a thermal treatment to the R-T-B based sintered magnet in an atmosphere containing a vapor of the heavy rare earth element. With this step, the coercivity of the R-T-B based sintered magnet can be further improved.

[Surface Treatment Step: Step S19]

A surface treatment such as plating, resin coating, oxidization treatment, chemical conversion treatment and the like can be provided to the R-T-B based sintered magnet obtained from the steps above (a surface treatment step (Step S19)). Thus, the corrosion resistance can be further improved.

In addition, although the machining step (Step S17), the grain boundary diffusion step (Step S18) and the surface treatment step (Step S19) are performed in the present embodiment, these steps are not necessary to be performed.

The R-T-B based sintered magnet according to the present embodiment is manufactured as above, and the treatment ends. In addition, a magnet product can be obtained by magnetizing the obtained magnet.

In thus obtained R-T-B based sintered magnet according to the present embodiment, as main phase grains with the mass concentration of Zr at the edge portion in the main phase grain being lower than that at the central portion in the main phase grain are contained as the main phase grain, the decrease of the residual magnetic flux density and the decrease of coercivity accompanying the increased content of Zr can be inhibited. In addition, the grain growth during sintering can be prevented even if a pulverized raw material powder with a small particle size is used.

The R-T-B based sintered magnet of the present embodiment can be suitably used as a magnet in, for example, a surface permanent magnet (SPM) type rotating machine with an magnet attached on the surface of a rotor, an interior permanent magnet (IPM) type rotating machine such as an inner rotor type brushless motor, a PRM (permanent magnet reluctance motor) or the like. In particular, the R-T-B based sintered magnet of the present embodiment is applicable to a spindle motor for a hard disk rotating drive or a voice coil motor in a hard disk drive, a motor for an electric vehicle or a hybrid car, a motor for an electric power steering motor in an automobile, a servo motor for a machine tool, a motor for a vibrator in a cellular phone, a motor for a printer, a motor for a generator and the like.

The present invention will not be limited to the embodiment above, and various modifications are available within the scope of the present invention.

EXAMPLES

Hereinafter, the present invention will be described in more details based on the examples. However, the present invention will not be limited to the following examples.

<Manufacturing an R-T-B Based Sintered Magnet>

Example 1

First of all, a raw material alloy was prepared by a strip casting method which can provide a sintered magnet with a composition (Composition A, i.e., 24.50 mass % of Nd-7.00 mass % of Pr-0.50 mass % of Co-0.45 mass % of Ga-0.20 mass % of Al-0.20 mass % of Cu-0.86 mass % of B-1.00 mass % of Zr-bal. of Fe). The casting process was performed at a molten metal temperature of 1500° C. and a cooling rate of about 2000° C./minute. Further, bal. referred to the remaining amount when the whole composition was deemed as 100 mass %.

Next, the hydrogen pulverization treatment (i.e., the coarse pulverization) was done. In particular, after hydrogen is stored to the raw material alloy at room temperature, dehydrogenation was performed at 500° C. for 1 hour at an Ar atmosphere.

In addition, in the present example, each step, from the hydrogen pulverization treatment to the sintering step, (the fine pulverization and pressing step) was done in an Ar atmosphere with the oxygen concentration therein being lower than 50 ppm (the same conditions were applied to the following examples and comparative examples).

Next, 0.3 mass % of oleic amide was added as the pulverization aid in the obtained coarsely pulverized powder. Then, the mixture was mixed by a Nauta mixer. And then, a jet mill was used to perform the fine pulverization so as to provide a finely pulverized powder having an average particle size of around 2.8 μm.

Subsequently, the obtained finely pulverized powder was filled in a press mold arranged in an electromagnet, and the pressing was performed under an applied pressure of 120 MPa in a magnetic field of 1200 kA/m. In this way, a green compact was obtained.

After that, the green compact was sintered under vacuum at 1070° C. for 8 hours. After the sintering, the temperature was slowly cooled to 800° C. in a cooling rate of 4° C./minute followed by a rapid cooling process in a cooling rate of 40° C./minute until room temperature. As such, a sintered body (the R-T-B based sintered magnet) was provided. Next, a two-stage aging treatment was performed to the obtained sintered body at 850° C. for 1 hour and then at 500° C. for 1 hour (both at an Ar atmosphere). In this respect, the R-T-B based sintered magnets of Examples 1 to 6 were obtained.

Examples 2 to 4 and Comparative Example 1

R-T-B based sintered magnets of Examples 2 to 4 and Comparative Example 1 were obtained as in Example 1 except that the cooling rate during the cooling process from the sintering temperature to 800° C. was set at the values listed in Table 1.

Figure 4:
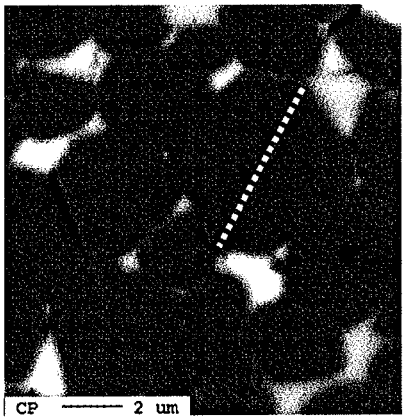
FIG. 4 is a backscattered electron image showing the cross-section of the R-T-B based sintered magnet obtained from Example 1.
Figure 5:
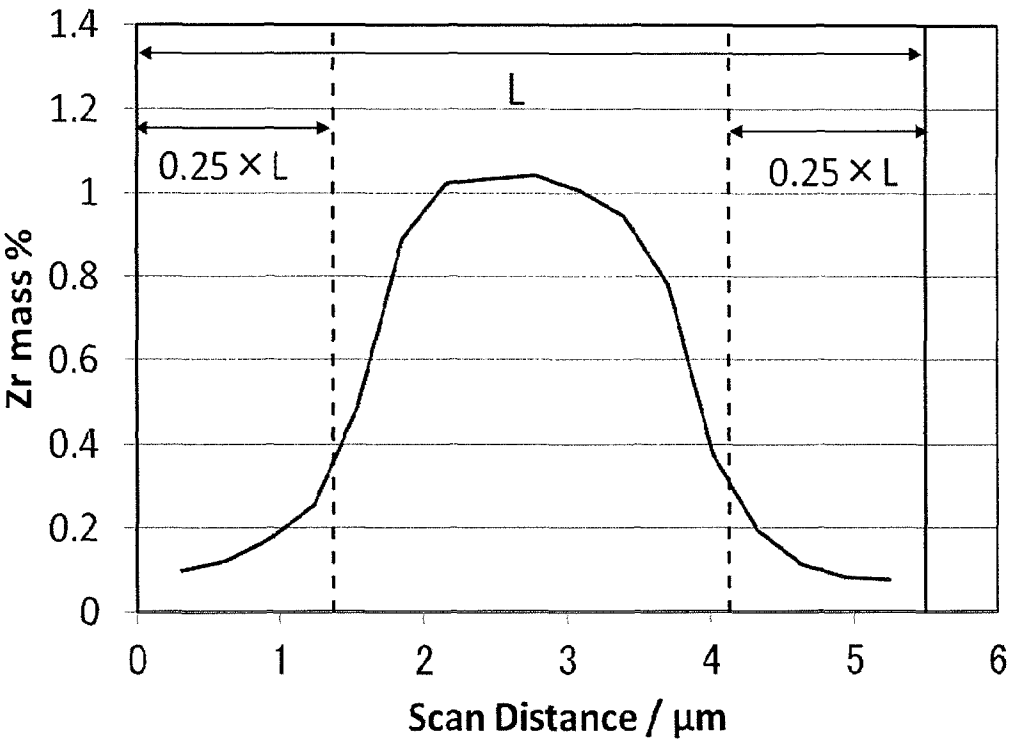
FIG. 5 shows the result from a quantitative analysis of Zr concentration by EPMA in a main phase grain in the R-T-B based sintered magnet from Example 1 along a straight line crossing through the gravity center of the grain.

The surface of a cross-section of each R-T-B based sintered magnet was milled by an ion milling to eliminate the influence from the oxidation on the outermost surface or the like, and then the cross-section of the R-T-B based sintered magnet was estimated by EPMA (Electron Probe Micro Analyzer). FIG. 4 showed the backscattered electron image of a cross-section in the R-T-B based sintered magnet of Example 1. The darker part represented the main phase grains under dark contrast. One main phase grain in the backscattered electron image of FIG. 4 was quantitatively analyzed for the concentration of Zr along a straight line running through the gravity center of the grain (the dotted line in FIG. 4) with an interval of 0.3 μm between two adjacent analysis points, and the results were shown in FIG. 5. It was confirmed that Mc (i.e., the mass concentration of Zr at the central portion of the main phase grain) was 0.84 mass % and Ms (i.e., the mass concentration of Zr at the edge portion of the main phase grain) was 0.14 mass %. Also, it was confirmed that the ratio (Ms/Mc) of Ms (the mass concentration of Zr at the edge portion of the main phase grain) to Mc (the mass concentration of Zr at the central portion of the main phase grain) was 70% or less.

The same analysis was done on each R-T-B based sintered magnet of Examples 2 to 4 and Comparative Example 1, and the results were shown in Table 1. The Ms/Mc value became larger when the cooling rate during the cooling process from the sintering temperature to 800° C. became faster. In Comparative Example 1 in which the cooling rate during the cooling process from the sintering temperature to 800° C. was set as 40° C./minute, Ms/Mc reached a value higher than 70%.

TABLE 1

| | Cooling rate during cooling process to 800° C. (° C./min) | Oxygen content (ppm) | Carbon content (ppm) | Mass concentration of Zr at central portion (Mc) (mass %) | Mass concentration of Zr at edge portion (Ms) (mass %) | Ms/Mc (%) | Magnetic properties Br (mT) | Magnetic properties HcJ (kA/m) | HcJ difference compared with Comparative Example (kA/m) |
|---|---|---|---|---|---|---|---|---|---|
| Example 1 | 4 | 910 | 1510 | 0.84 | 0.14 | 17% | 1351 | 1685 | 93 |
| Example 2 | 6 | 860 | 1490 | 0.89 | 0.22 | 25% | 1353 | 1654 | 62 |
| Example 3 | 8 | 930 | 1530 | 0.95 | 0.38 | 40% | 1349 | 1650 | 58 |
| Example 4 | 12 | 870 | 1520 | 0.99 | 0.69 | 70% | 1350 | 1622 | 30 |
| Comparative Example 1 | 40 | 900 | 1510 | 1.01 | 0.82 | 81% | 1348 | 1592 | |

Each of R-T-B based sintered magnets obtained in Examples 1 to 4 and Comparative Example 1 was subjected to a composition analysis through an X-ray fluorescence analysis together with an inductively coupled plasma mass spectrometry (ICP-MS). As a result, it was confirmed that the composition of any one of the R-T-B based sintered magnet was almost the same with the target composition. In addition, the oxygen content was measured by an inert gas fusion-non-dispersive infrared absorption method, and the carbon content was measured by a combustion in an oxygen airflow-infrared absorption method. The results concerning the oxygen content and the carbon content were shown in Table 1.

Regarding each of R-T-B based sintered magnets of Examples 1 to 4 and Comparative Example 1, the average grain size of the main phase grains was estimated. With respect to the average grain size of the main phase grains, the cross-section of a sample was ground and then observed by an optical microscope, and the sectional image was put into image analysis software so as to determine the distribution of grain size in the main phase grains. In any one of the sintered magnets, the average grain size of the main phase grains was 3.3 μm.

The magnetic properties of the R-T-B based sintered magnet obtained from Examples 1 to 4 and Comparative Example 1 were determined by using a B-H tracer. The residual magnetic flux density Br and the coercivity HcJ were measured as the magnetic properties. The results from the measurement of the residual magnetic flux density Br and the coercivity HcJ in each R-T-B based sintered magnet were shown in Table 1. The coercivity differences between each R-T-B based sintered magnet from Examples 1 to 4 and the R-T-B based sintered magnet from Comparative Example 1 were also shown in Table 1. And it was confirmed that the R-T-B based sintered magnets from Examples 1 to 4 had higher coercivity HcJ than that from Comparative Example 1.

Examples 5 to 9 and Comparative Examples 2 to 6

R-T-B based sintered magnets of Examples 5 to 9 were manufactured as in Example 1 except that the raw material alloys were prepared by the strip casting method to provide sintered magnets having Compositions B to F as shown in Table 2. Further, R-T-B based sintered magnets of Comparative Examples 2 to 6 were manufactured as in Comparative Example 1 except that the raw material alloys were prepared by the strip casting method to provide sintered magnets having Compositions B to F as shown in Table 2.

The composition analysis of each R-T-B based sintered magnet from Examples 5 to 9 and Comparative Examples 2 to 6 was similarly performed as in Example 1. As a result, it was confirmed that the composition of any one of the R-T-B based sintered magnets was substantially the same as the target composition (each composition as shown in Table 2). Further, as in Example 1, the oxygen content, the carbon content and the average grain size of the main phase gains were analyzed. The results were collectively shown in Table 3.

TABLE 2

| | Composition (mass %) | | | | | | | | | | | Corresponding | Corresponding Comparative |
|---|---|---|---|---|---|---|---|---|---|---|---|---|---|
| | Nd | Pr | Dy | (T. RE) | Co | Ga | Al | Cu | B | Zr | Fe | Examples | Examples |
| Composition A | 24.50 | 7.00 | 0.00 | 31.50 | 0.50 | 0.45 | 0.20 | 0.20 | 0.86 | 1.00 | bal. | Examples 1 to 4 | Comparative Example 1 |
| Composition B | 31.00 | 0.00 | 0.00 | 31.00 | 1.50 | 0.70 | 0.10 | 0.10 | 0.82 | 0.60 | bal. | Example 5 | Comparative Example 2 |
| Composition C | 24.00 | 7.00 | 1.00 | 32.00 | 1.00 | 0.30 | 0.20 | 0.30 | 0.90 | 1.30 | bal. | Example 6 | Comparative Example 3 |
| Composition D | 30.50 | 0.00 | 2.00 | 32.50 | 2.00 | 1.00 | 0.20 | 0.50 | 0.75 | 0.30 | bal. | Example 7 | Comparative Example 4 |
| Composition E | 24.00 | 6.00 | 0.00 | 30.00 | 0.50 | 0.60 | 0.20 | 1.00 | 0.80 | 0.50 | bal. | Example 8 | Comparative Example 5 |
| Composition F | 24.50 | 7.50 | 0.00 | 32.00 | 1.00 | 0.80 | 0.60 | 0.60 | 0.78 | 2.00 | bal. | Example 9 | Comparative Example 6 |
| Composition G | 24.50 | 7.00 | 0.00 | 31.50 | 0.50 | 0.45 | 0.20 | 0.20 | 0.86 | 0.25 | bal. | | Comparative Example 7 |
| Composition H | 24.50 | 7.00 | 0.00 | 31.50 | 0.50 | 0.45 | 0.20 | 0.20 | 0.86 | 2.50 | bal. | | Comparative Example 8 |

With respect to each R-T-B based sintered magnet from Examples 5 to 9 and Comparative Examples 2 to 6, an analysis on the mass concentration of Zr in the main phase grains was similarly performed as in Example 1. The results were shown in Table 3. All the Ms/Mc values were 70% or less in the R-T-B based sintered magnets from Examples 5 to 9. In contrast, the Ms/Mc values were higher than 70% in the R-T-B based sintered magnets from Comparative Examples 2 to 6.

As in Example 1, the magnetic properties of each R-T-B based sintered magnet from Examples 5 to 9 and Comparative Examples 2 to 6 were similarly evaluated. The results were shown in Table 3. If the R-T-B based sintered magnets in Examples 5 to 9 were respectively compared to those in the Comparative Examples having the same composition, it could be seen that the R-T-B based sintered magnet from Examples had a higher coercivity than that from the Comparative Examples having the same composition.

TABLE 3

| | Composition | Oxygen content (ppm) | Carbon content (ppm) | Average grain size of main phase grains (μm) | Mass concentration of Zr at central portion (Mc) (mass %) | Mass concentration of Zr at edge portion (Ms) (mass %) | Ms/Mc (%) | Magnetic properties Br (mT) | Magnetic properties HcJ (kA/m) | HcJ difference compared with Comparative Example (kA/m) |
|---|---|---|---|---|---|---|---|---|---|---|
| Example 5 | B | 760 | 1400 | 3.5 | 0.47 | 0.11 | 23% | 1338 | 1723 | 110 |
| Comparative Example 2 | | 810 | 1420 | 3.5 | 0.61 | 0.55 | 90% | 1332 | 1613 | |
| Example 6 | C | 850 | 1960 | 2.2 | 0.98 | 0.38 | 39% | 1340 | 1692 | 65 |
| Comparative Example 3 | | 860 | 1970 | 2.2 | 1.33 | 1.02 | 77% | 1332 | 1627 | |
| Example 7 | D | 1030 | 1620 | 2.8 | 0.28 | 0.16 | 57% | 1281 | 2034 | 37 |
| Comparative Example 4 | | 1060 | 1600 | 2.8 | 0.30 | 0.26 | 87% | 1275 | 1997 | |
| Example 8 | E | 1150 | 1210 | 4.0 | 0.43 | 0.16 | 37% | 1371 | 1594 | 73 |
| Comparative Example 5 | | 1210 | 1230 | 4.0 | 0.49 | 0.42 | 86% | 1359 | 1521 | |
| Example 9 | F | 1400 | 2480 | 1.5 | 1.76 | 0.47 | 27% | 1302 | 1834 | 78 |
| Comparative Example 6 | | 1350 | 2520 | 1.5 | 1.92 | 1.52 | 79% | 1295 | 1756 | |

Comparative Examples 7 and 8

R-T-B based sintered magnets of Comparative Examples 7 and 8 were manufactured as in Example 1 except that the raw material alloys were prepared by the strip casting method to provide the sintered magnets having Compositions G and H as shown in Table 2. In addition, Composition G is the same with Composition A in Example 1 except that the content of Zr was changed to 0.25 mass %, and Composition H is the same with Composition A in Example 1 except that the content of Zr was changed to 2.5 mass %.

The composition analysis of each R-T-B based sintered magnet from Comparative Examples 7 and 8 was similarly performed as in Example 1. As a result, it was confirmed that the composition of either R-T-B based sintered magnet was substantially the same as the target composition (each composition as shown in Table 2). Further, as in Example 1, the oxygen content, the carbon content and the average grain size of the main phase gains were analyzed. The results were shown in Table 4. In the sample from Comparative Example 7 with lower Zr content, abnormal grain growth occurred during the sintering process, and the average grain size of the main phase grains became extremely large compared to that in Example 1.

TABLE 4

| | Composition | Zr content (mass %) | Oxygen content (ppm) | Carbon content (ppm) | Average grain size of main phase grains (μm) | Magnetic properties Br (mT) | HcJ (kA/m) |
|---|---|---|---|---|---|---|---|
| Comparative Example 7 | G | 0.25 | 880 | 1530 | 6.2 | 1386 | 912 |
| Comparative Example 8 | H | 2.5 | 870 | 1520 | 3.2 | 1136 | 1442 |
| Example 1 | A | 1.0 | 910 | 1510 | 3.3 | 1351 | 1685 |

The magnetic properties of each R-T-B based sintered magnet obtained in Comparative Examples 7 and 8 were similarly estimated as in Example 1. The results were shown in Table 4 together with the results from Example 1. It could be seen that the magnet from Comparative Example 7 with lower content of Zr had a substantial reduction in coercivity due to the influence of the abnormal grain growth compared to Example 1. In addition, the magnet from Comparative Example 8 with a higher Zr content resulted in a substantial decrease in residual magnetic flux density.

DESCRIPTION OF REFERENCE NUMERALS

2 Main phase grain
4 Central portion
6 Edge portion
8 Grain boundary phase

What is claimed is:

1. An R-T-B based sintered magnet comprising an R-T-B based compound as main phase grains, wherein, R represents at least one rare earth element, T represents one or more iron family elements including Fe or the combination of Fe and Co, and B represents boron, which may be partly substituted with carbon, the content of R is 25 to 35 mass %, the content of B is 0.5 to 1.5 mass %, the content of Cu is 0.1 to 1.0 mass %, the content of Ga is 0.3 to 1.0 mass %, the content of Zr contained in the R-T-B based sintered magnet is 0.3 mass % to 2.0 mass %, the main phase grains comprises Zr, the R-T-B based sintered magnet comprises main phase grains having a structure in which the mass concentration of Zr at the edge portion in each of the main phase grains is 70% or less of that at the central portion in each of the main phase grains at the cross-section of each of the main phase grains, the mass concentration of Zr at the edge portion is based on the average of four or more analysis points of each main phase grain at said cross-section, the mass concentration of Zr at the central portion is based on the average of four or more analysis points of each main phase grain at said cross-section, and the main phase grains having said structure account for 30% or more of the total main phase grains.

2. The R-T-B based sintered magnet of claim 1 comprising main phase grains in which the mass concentration of Zr at the edge portion in each of the main phase grains is 40% or less of that at the central portion in each of the main phase grains at the cross-section of each of the main phase grains.

3. The R-T-B based sintered magnet of claim 1, wherein, the mass concentration of Zr at the edge portion of each of the main phase grains is 0.15 mass % or less.

4. The R-T-B based sintered magnet of claim 2, wherein, the mass concentration of Zr at the edge portion of each of the main phase grains is 0.15 mass % or less.

5. The R-T-B based sintered magnet of claim 1, wherein the content of Ga is 0.45 mass % to 1.0 mass %.

6. The R-T-B based sintered magnet of claim 2, wherein the content of Ga is 0.45 mass % to 1.0 mass %.

7. The R-T-B based sintered magnet of claim 1, wherein the content of Zr contained in the R-T-B based sintered magnet is 0.5 mass % to 1.30 mass %.

8. The R-T-B based sintered magnet of claim 2, wherein the content of Zr contained in the R-T-B based sintered magnet is 0.5 mass % to 1.30 mass %.

* * * * *